United States Patent [19]

York et al.

[11] Patent Number: 4,602,776

[45] Date of Patent: Jul. 29, 1986

[54] INSERTION APPARATUS FOR USE WITH COPIER/SORTER SYSTEM

[75] Inventors: James R. York, Webster; Hugh L. Jones, Rochester, both of N.Y.

[73] Assignee: Xerox Corporation, Stamford, Conn.

[21] Appl. No.: 663,620

[22] Filed: Oct. 22, 1984

[51] Int. Cl.[4] ..... B65H 5/22

[52] U.S. Cl. ..... 271/4; 271/296; 271/303; 355/14 SH; 414/42; 414/901

[58] Field of Search ..... 271/4, 6, 7, 287–290, 271/296–298, 303, 305; 414/42, 901; 355/3 SH, 14 SH

[56] References Cited

U.S. PATENT DOCUMENTS

| | | | |
|---|---|---|---|
| 2,922,640 | 1/1960 | Fornell et al. | 271/297 |
| 3,709,492 | 1/1973 | Baker et al. | 271/64 |
| 3,870,295 | 3/1975 | Kukucka | 271/173 |
| 4,054,380 | 10/1977 | Donohue et al. | 355/14 R |
| 4,145,038 | 3/1979 | Mol | 270/58 |
| 4,248,525 | 2/1981 | Sterrett | 355/14 SH |
| 4,439,865 | 3/1984 | Kikuchi et al. | 271/288 |

*Primary Examiner*—Bruce H. Stoner, Jr.
*Assistant Examiner*—John A. Carroll
*Attorney, Agent, or Firm*—Bernard A. Chiama

[57] ABSTRACT

An apparatus and method in conjunction with a copier and/or a collator is disclosed for providing on-line and off-line insertion of sheet material or collation, respectively. The apparatus includes a single supply tray and sheet feeder therefor. The supply tray is pre-loaded with one or more types of insert material, each type being separated by a coded sheet. As the insert sheets are fed, a sensor detects the coded sheet which is fed to an overflow tray and further feeding from the supply tray is inhibited until additional copy sheets from the copier is supplied in the on-line mode of operation, or a different type of material is to be collated in the off-line mode.

1 Claim, 11 Drawing Figures

10
11
P
SQL-1
101
102
C
K
45
12
SE-1
SE-2
M-1
M-2
35
36
37
31
30
44
46
47
40
41
42
43
48
49
50
51
52
53
54
60
62
65
66
67
68
69
70
72
74

SENSOR SE-2 DETECTOR CODE
NO
YES
INCREMENT 62a'', 62n TO END
COUNT > PROGRAM COUNT
NO
YES
FEED CLUTCH OFF
RESET TOTAL COUNTER
FEED CLUTCH OFF
INSERT FEED CLUTCH ON CODE SHEET TO TRAY 72
INSERT FEED CLUTCH OFF DEENERGIZE SOL-1
NO
END OF PROGRAM
YES
EXIT

SENSOR SE-2 DETECTS CODE
RESET TOTAL COUNTER
INCREMENT INDIVIDUAL STACK
FEED CLUTCH OFF GATE 68 ON
COUNT > PROGRAM COUNT
NO
YES
FEED CLUTCH ON
FEED CLUTCH OFF GATE 68 OFF
FEED CLUTCH OFF
INCREMENT SHEET IN PROCESS COUNTER
EXIT

INSERTION APPARATUS FOR USE WITH COPIER/SORTER SYSTEM

The present invention is directed to a sheet insertion apparatus for particular use with a copier having a sorter, but is also adapted for off-line use with a sorter as well to function as a collator therewith.

Generally, sheet insertion devices associated with a copier/sorter utilize internal portions of the copier, say for example, an auxilliary copy sheet tray, or a dedicated tray within the copier, and using portions of the normal paper path for copy sheets being processed. In many machines, insertion sheets utilize paths of movement which include the toner fixing apparatus for the copier.

In these copiers provided with insertion apparatus, generally only a single type of insert can be applied without operator intervention. If multiple groups of different insertion material is to be applied, the material for each insertion group must be counted out carefully to coordinate with the preselected number of collated copy sets to be produced. In the event of a paper jam, automatic job recovery is next to impossible except to re-count all of the groups of insertion material relative to the copy sets remaining to be produced once a jam is cleared. In the extreme, multiple copy set insertion can be attained utilizing a plurality of trays, one for each group of inserts, but if cost and space are important, an arrangement such as this is not feasible.

In the art of inserting insert material into copy sets for finishing, the use of a plurality of bins, one for each type of insert material, is disclosed in U.S. Pat. No. 4,248,525. A specific bin, sheet feeder, and attendant structure are needed for each of the groups of insert material, thus involving a very costly arrangement for multiple insertion while producing copy sets. Another apparatus which serves as a collator for producing stapled copy sets is disclosed in U.S. Pat. No. 4,145,038 which discloses a rotary sorter having a sheet feeder arranged to feed sheets from stacks in the bins of the sorter to a collation tray. Again, a multitude of bins are required to hold the individual stacks.

Therefore, it is a principal object of the present invention to achieve on-line insertion during sorting and off-line sheet insertion during collation for large reproduction jobs with minimal attendance by an operator and down time due to sheet jams.

The present invention is achieved by the use of a single supply tray for insert material in the form of sheets arranged to support a relatively large number of different groups of insert material. The groups are separated by coded sheets which for the copier/inserter/sorter mode of operation cooperate with selectively interleafed coded sheets in a document handling apparatus to effect the insertion of the proper insert material in copy sets being produced in accordance with where coded sheets are placed with a set of document sheets. The control arrangement is such that, upon completion of the insertion of material from each group of inserts, the remaining unused insert material is fed to an overflow tray in order to condition the insertion apparatus for feeding a succeeding group of insert material from the supply tray.

Other objects and advantages will become apparent after reading the specification taken in conjunction with the following drawings wherein.

Figure 4A:
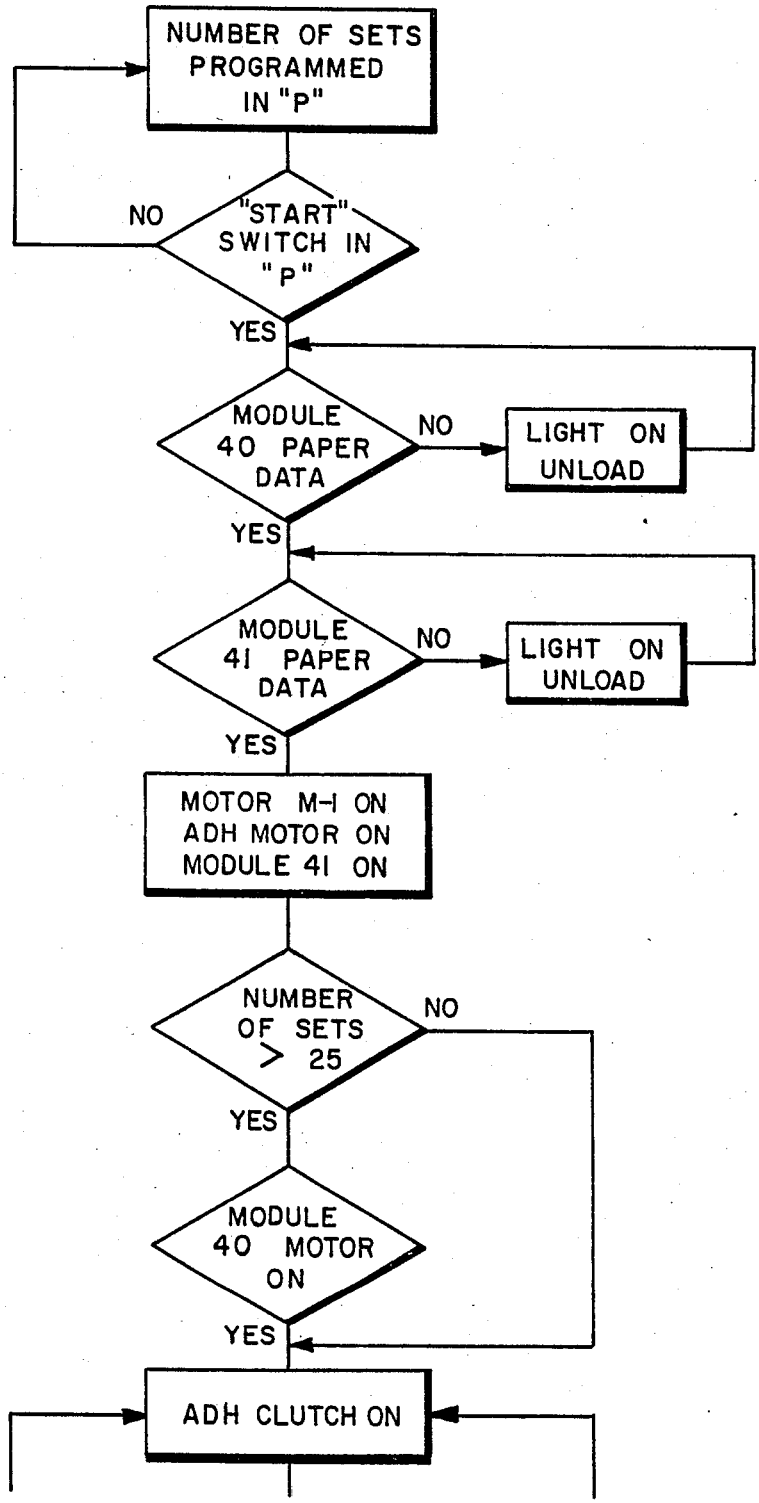
Figure 4B:
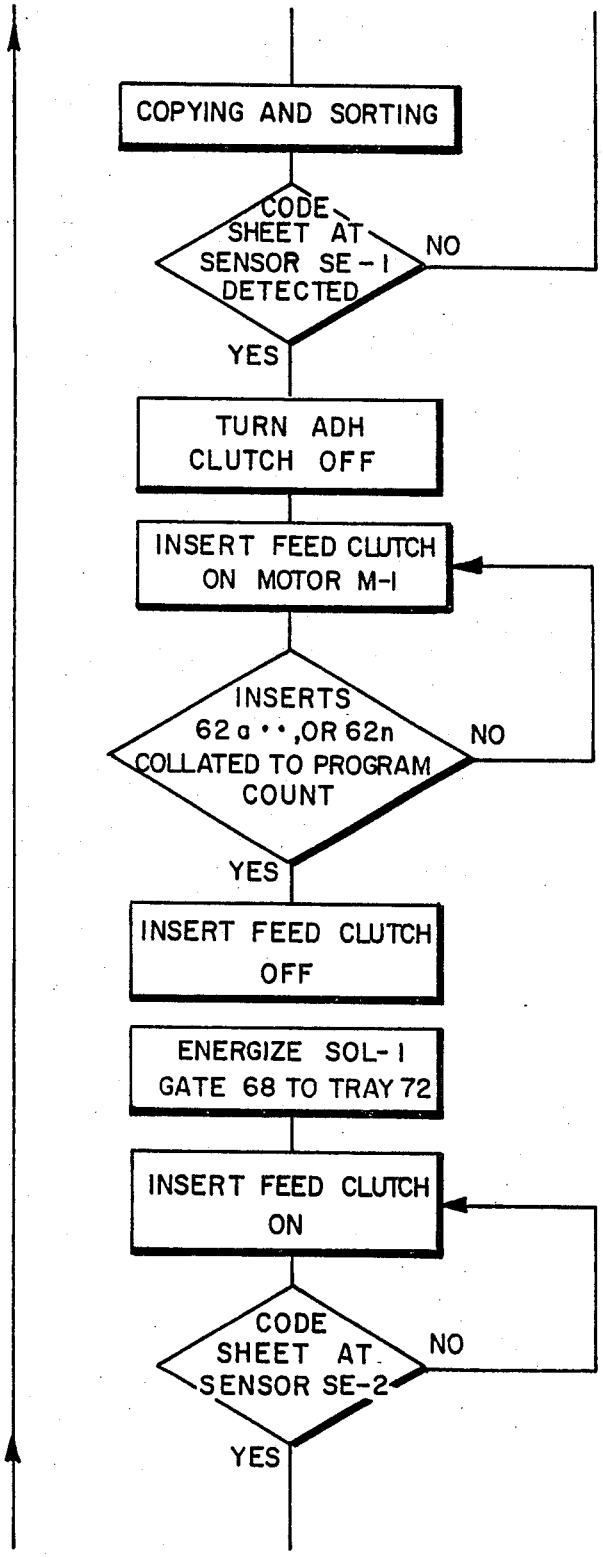
Figure 4C:
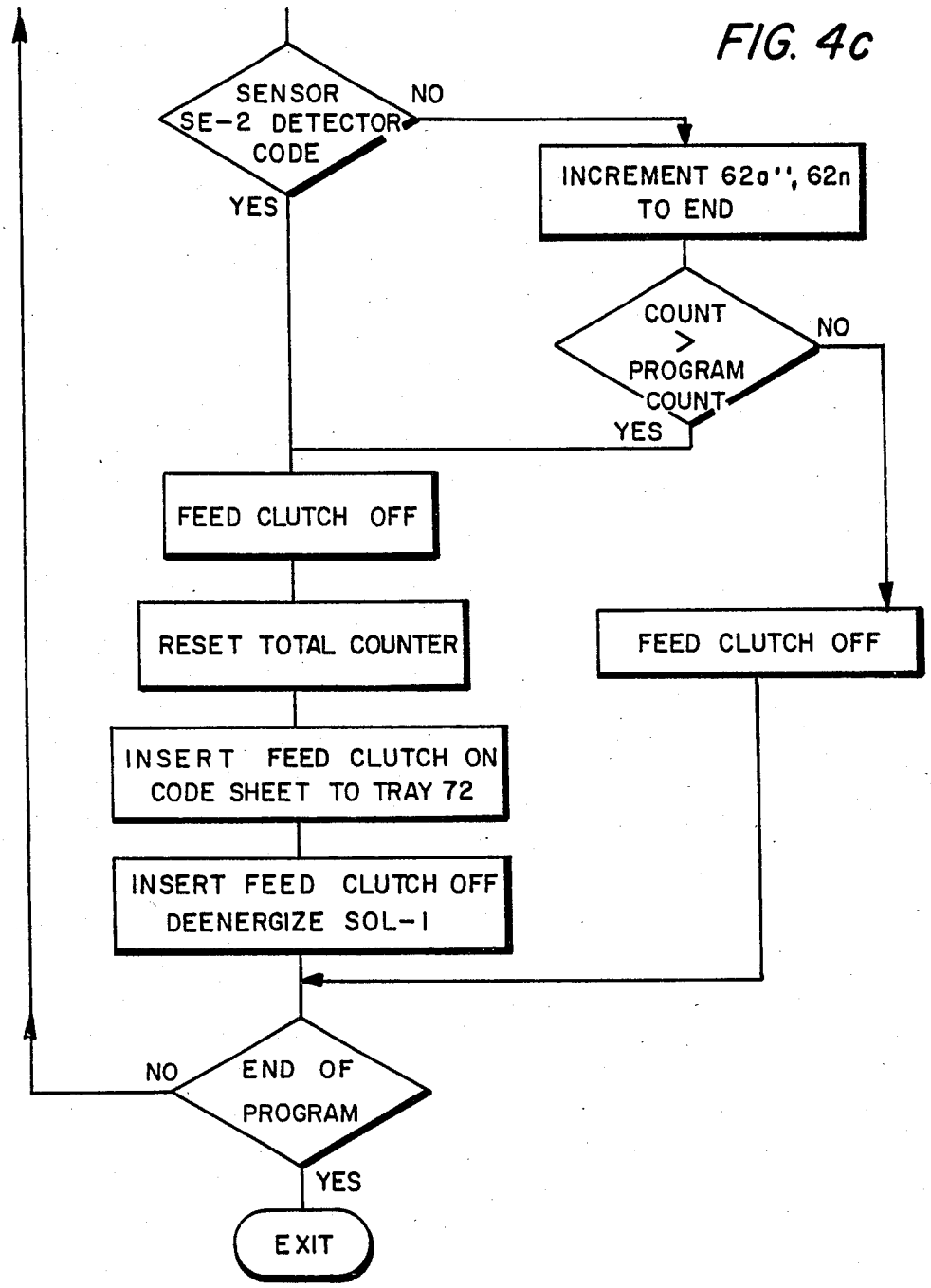
Figure 5A:
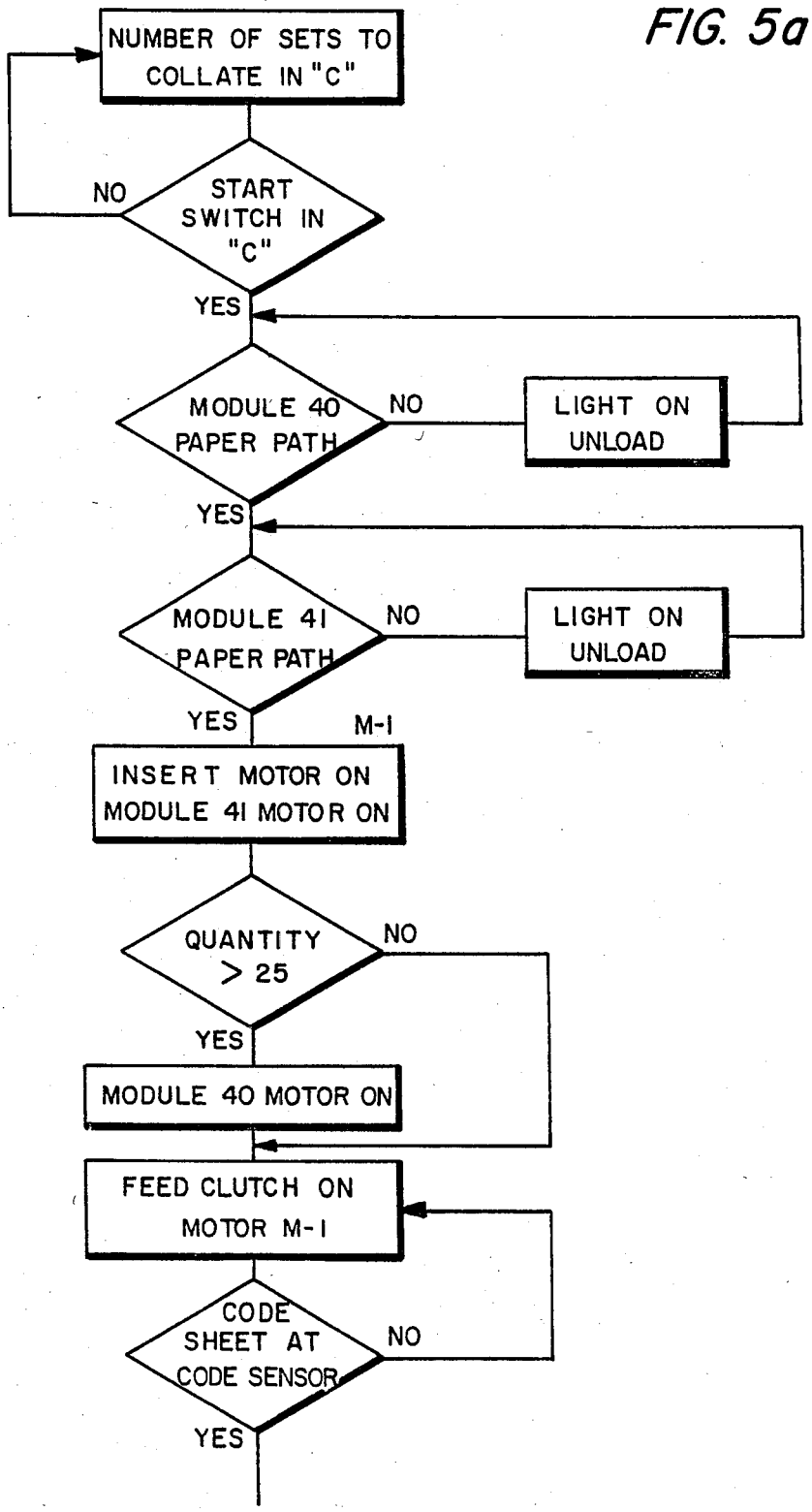
Figure 5B:
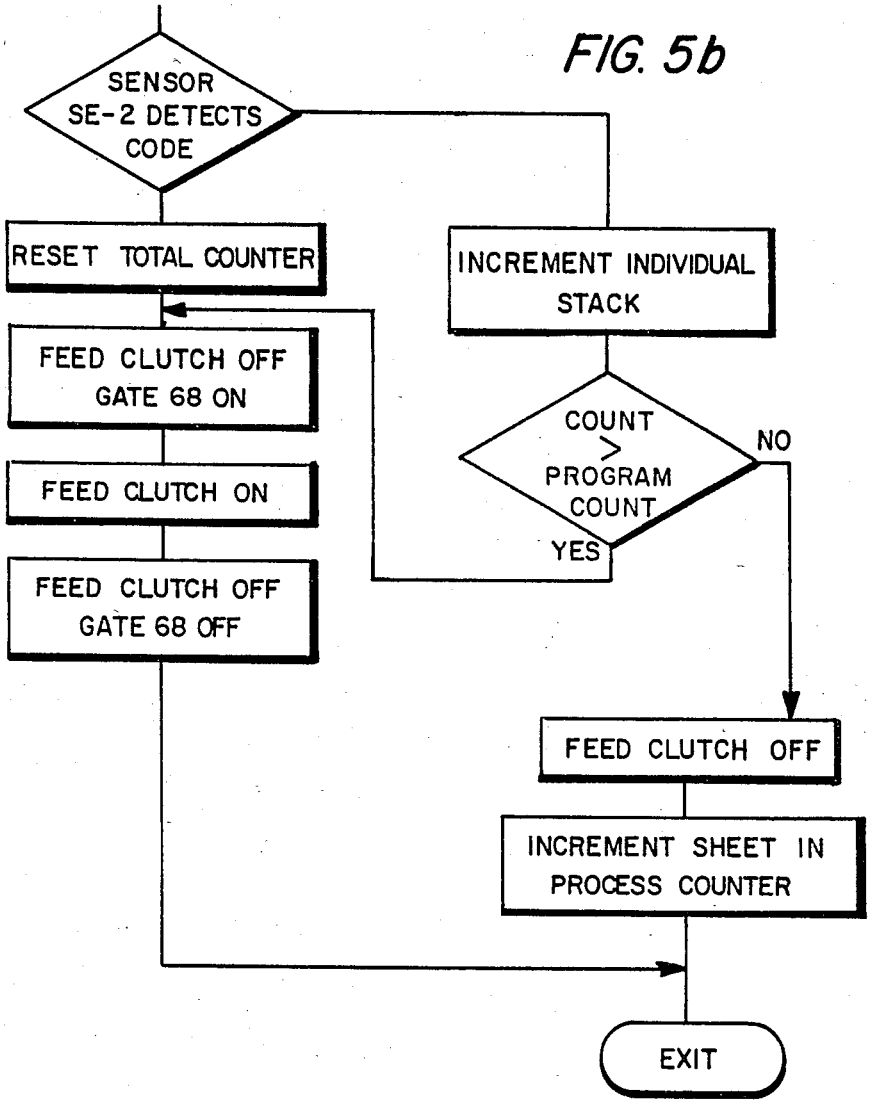
Figure 6:
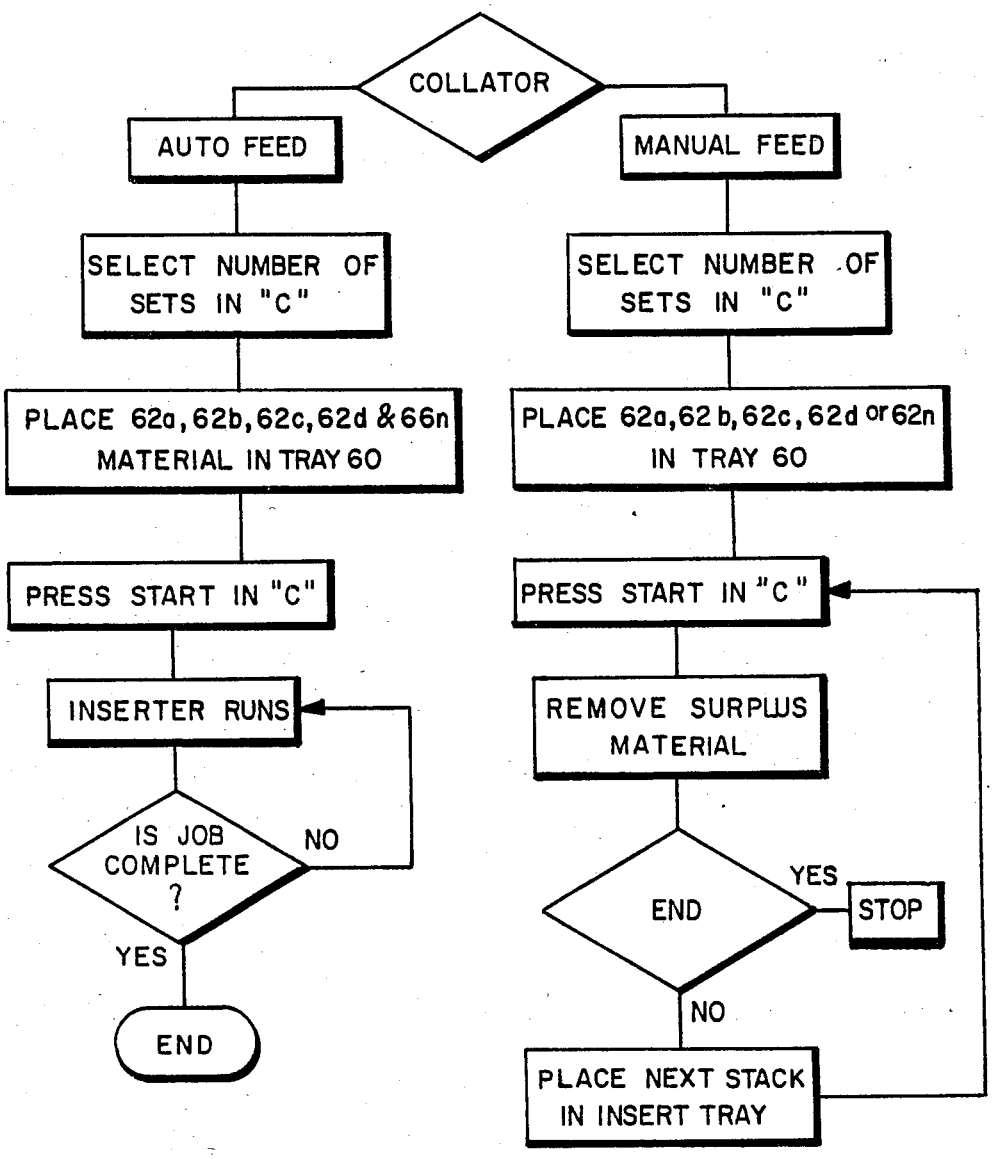
Figure 7:
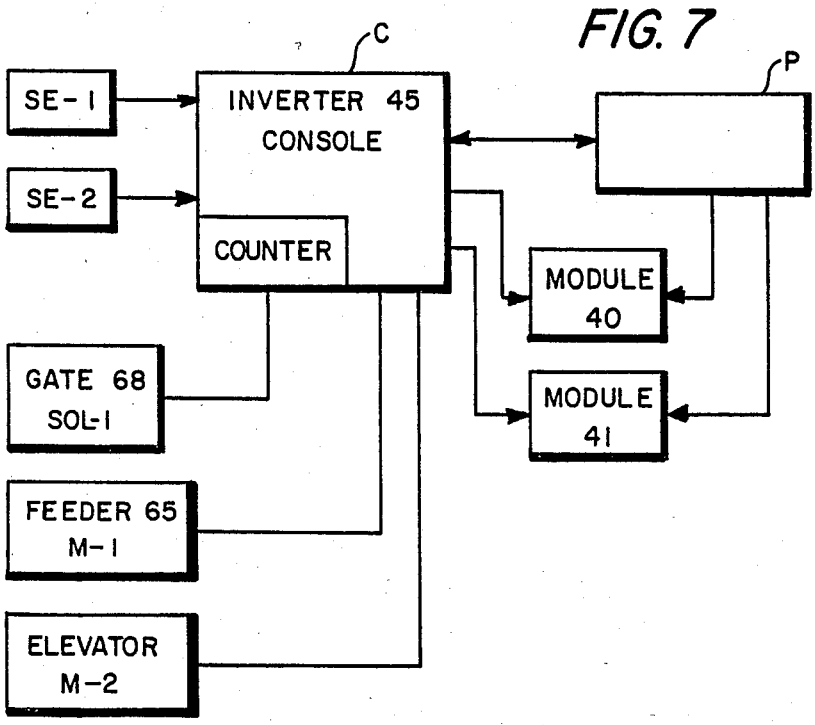
Figure 8:
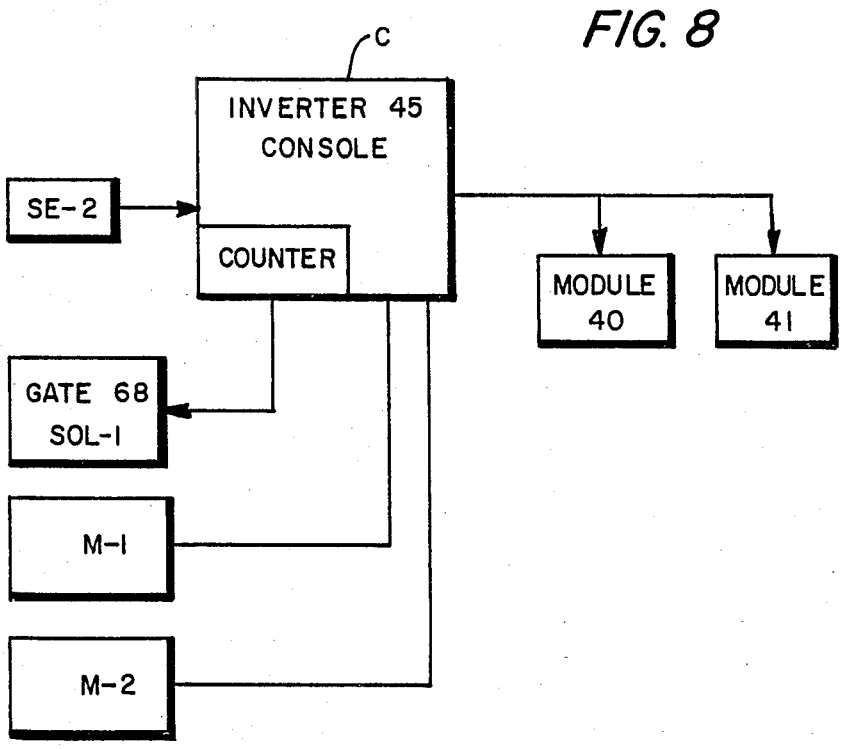

FIGS. 4*a*, 4*b*, 4*c*, are flow diagrams depicting control operation of the inserter apparatus in cooperation with a copier and a sorter;

FIGS. 5*a*, 5*b* are flow diagrams depicting control operation of the inserter in cooperation with a sorter;

FIG. 6 is a simplified flow diagram for the inserter/collator in both of its modes of operation: manual or automatic; and FIGS. 7 and 8 are control diagrams of the control operation of the inserter apparatus in on-line and off-line operations, respectively.

Figure 1:
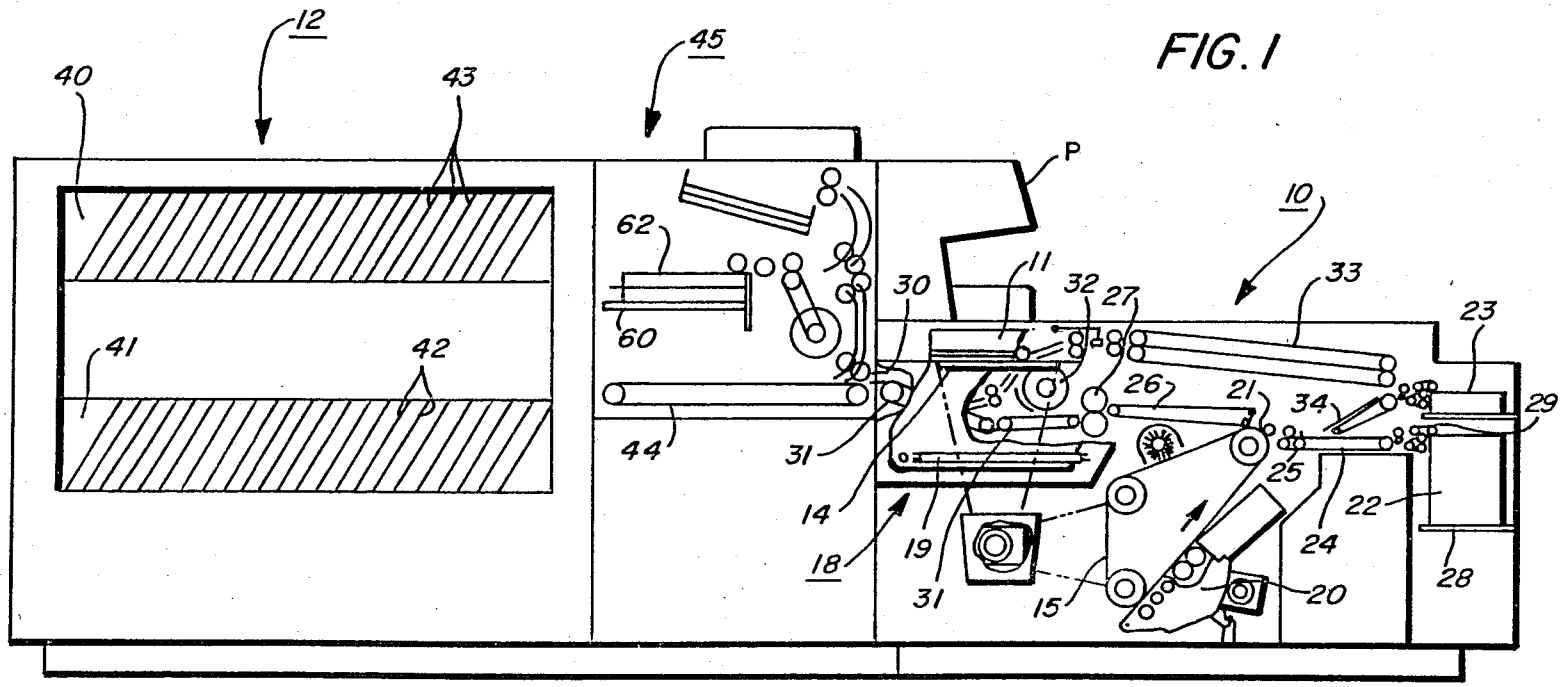
FIG. 1 is a schematic elevational view of a duplicating system employing the present invention.

For a general understanding of an automatic electrostatographic duplicating machine to which the present invention may be incorporated when utilized in the copier/inserter/sorter, or on-line mode, reference is made to FIG. 1 wherein components of a typical electrostatographic printing system are illustrated. The printing system is of the xerographic type as one including a xerographic copy sheet processor or copier 10, a document handling apparatus 11, and a sorter arrangement 12. Preferably, the printing system 10, 11, and 12 is the commercial, highly sophisticated embodiment of the Xerox model 9500 ® duplicator which utilizes flash, full frame exposure, for very high speed production. Document sheet handling and exposure, image processing, and copy sheet transport/handling are under control by a machine programmer P located in the machine control console and are effected in timed sequence in conjunction with the machine clock system, and in accordance with the program an operator has preset in the machine. Further details in this regard are not necessary since the Xerox 9500 ® duplicator operates in this manner and is well known. Details of the timing relationships and devices, the programmer, and related structure and events are described in U.S. Pat. Nos. 3,790,270; 3,796,486; and 3,917,396, commonly assigned and which are incorporated by reference.

As in all xerographic systems, a light image of an original is projected onto the sensitized surface of a xerographic photosensitive surface to form an electrostatic latent image thereon. Thereafter, the latent image is developed with toner material to form a xerographic powder image corresponding to the latent image on the photosensitive surface. The powder image is then electrostatically transferred to a record material such as a sheet of paper or the like to which it may be fused by a fusing device whereby the powder image is caused to adhere permanently to the surface of the record material.

The xerographic processor or copier 10 is arranged as a selfcontained unit having all of its processing stations located in a unitary enclosure or cabinet. The processor includes an exposure station at which an original to be reproduced is positioned on a glass exposure platen 14 for projection onto a photosensitive surface in the form of a xerographic belt 15. The original or set of individual document sheets are selectively transported by the document feed apparatus 11 one document sheet at a time to the platen 14 for exposure. After a predetermined number of exposures of each document sheet is made, the same is returned to the top of the set until the entire set has been circulated and copied. A suitable document handling apparatus of this type is described in U.S. Pat. No. 3,944,794, commonly assigned, which is hereby incorporated by reference.

Imaging light rays from each of the document sheets, which are flash illuminated for exposure by an illumination system 18 having suitable lamps 19, are projected onto the xerographic belt 15. The lamps 19 are connected to a suitable flashing circuit (not shown) which is controlled by the programmer P for the processor in timed sequence, and in accordance with the program the operator has preset in the machine. Further details in this regard are not necessary since the Xerox 9500 ® reproduction machine operates in this manner and is well known.

The xerographic belt 15 is mounted for movement around three parallel arranged rollers suitable mounted in the processor 11. The belt is continuously driven by a suitable motor (not shown) and at an appropriate speed. The exposure of the belt to the imaging light rays from an original or document sheet discharges the photoconductive layer in the area struck by light whereby there remains on the belt an electrostatic latent image corresponding to the light image projected from the document. As the belt continues its movement, the electrostatic latent image passes a developing station at which there is positioned a developer apparatus 20 for developing the electrostatic latent image.

After development, the powdered image is moved to an image transfer station 21 whereat the developed image is transferred to a support surface, normally a sheet of copy paper, brought from a main or auxilliary paper tray 22, 23, respectively, as will appear.

Each sheet is conveyed to the transfer station by a conveyor 24 which cooperates with sheet registration fingers 25. These fingers engage the leading edge of a sheet, being adapted to effect the accurate timing and positioning of a sheet relative to the movement of a developed image on the belt 15 and the other timed events in reproduction processing. Further details of the timing relationships and related structure and events are described in U.S. Pat. Nos. 3,790,270; 3,796,486; and 3,917,396, commonly assigned, and which are incorporated herein by reference.

The sheet is moved in synchronism with the movement of the belt 15, and passes between a transfer roller and the belt 15 at the transfer station. After transfer, the sheet of paper is stripped off the belt 15 and transported by a vacuum conveyor 26 in an inverted condition to a fusing station where a fuser device 27 is positioned to receive the sheet of paper for fixing by fusing the powder thereon. After fusing, the sheet is eventually transported to a sorter apparatus to be described hereinafter to be collated into copy sets or merely to be stacked, as pre-programmed.

The system comprising the processor 10, the document handling apparatus 11, and the sorter apparatus 12 is under control of the programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode; to select one of a plurality of paper supply trays; to condition the machine for the type of document, that is, whether one-sided or two-sided, to select a copy size reduction mode, and other desirable functions. The programmer P also includes a controller which provides all operational timing and synchronization between the processor 10 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, Calif., and having sufficient ROM's and RAM's for all of the necessary functions in the reproduction system. Detailed description of the processor 10 working in conjunction with the document handling apparatus 11 for both simplex and duplex copying may be found in U.S. Pat. No. 4,054,380, the contents of which are hereby incorporated herein by reference.

As previously stated, copy sheets are supplied from either the main paper tray 22 or the auxiliary paper tray 23. Main paper tray 22 includes a suitable elevator type base 28 on which a supply of sheets rest, base 28 being supported for automatic up and down movement by suitable means (not shown) designated to maintain paper feed belt 29 in operative contact with the topmost one of the sheets on the elevator 28. The belt 29 is operated intermittently in timed relationship to spacing of images on the photoreceptor belt 15 and serves to advance the topmost sheet from the copy sheet supply stack on the tray 22 to the main paper supply transport 24.

The auxiliary tray 23, in the exemplary arrangement shown, is arranged above main tray 22 and also includes a suitable elevator type base on which a supply of sheets may be provided. As with the main supply tray 22 suitable means (not shown) are provided to raise this elevator base for auxiliary tray 23 as the supply of sheets thereon are used up so as to maintain a paper feed belt 39 in operative contact with the topmost sheet. Further details of the sheet feeders for the feeders 22, 23, the transporting of copy sheets to the transfer station, and the timing of these operations, are not necessary for understanding the present invention. Such detail are described in the above indicated U.S. Pat. No. 4,054,380.

During use, copy sheets leaving the processor 10 after exiting the fuser apparatus 27 are conveyed to an exit slot 30, by way of transports 31, if the reproduction system is set for the simplex or one-sided copying. If the system has been programmed for duplex or two-sided copying, the one-sided copy sheets will be directed to the auxiliary tray 23. If the latter mode of operation is selected, copy sheets conveyed by the transport 31 are intercepted, carried around a roller 32 and advanced by rollers and sheet guides to a transport mechanism 33 which carries the sheet to the auxiliary paper tray 23. When the desired number of one-sided copies have been produced and delivered to the tray 23, the paper handling mechanism for this tray is activated. It should be understood that in following the paper path around roller 32, the copy sheets are turned over, i.e. the printed material is on the top of the sheets in the tray 23.

Upon reenergization of the system, the sheets from the tray 23 are fed through the reproduction machine by means of a feed belt 34 and the transport 24 for copying on the blank side of the sheet in the same manner as described heretofore. The auxiliary tray 23 may also serve as a supply for insert sheets during a reproduction job wherein the sorter apparatus 12 is conditioned for collation of the output into collated copy sets.

Figure 2:
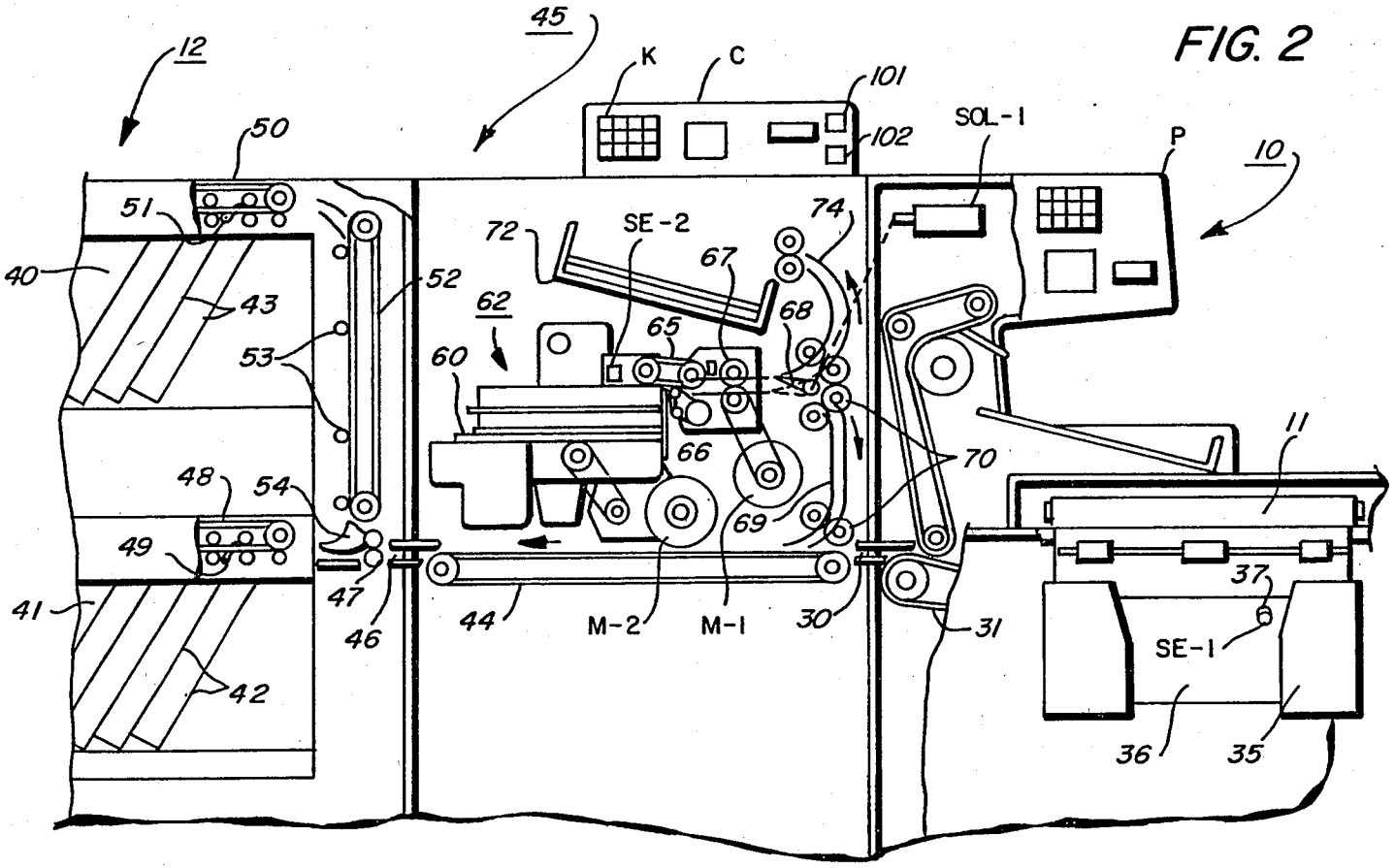
FIG. 2 is a partial elevational view of the sheet inserter module associated with the duplicating system.

The document handling apparatus 11 serves to feed one document sheet at a time from a supply of document sheets into copying position on the platen 14 where a single exposure if only one copy set is programmed, or a plurality of exposures may be made. Following exposure one or more times, each document sheet is automatically returned to the document supply and the next document sheet, if any, is brought into the exposure position on plate 14. As will appear, document sheets returned to the supply stack may be recycled by the apparatus 11 or simply returned by the user when the copying program is completed. As shown in FIG. 2, the document handling apparatus 11 includes base section 35, the lower end of which swingably supports a sheet guide plate 36 having formed therein an aperture 37 through which document sheets may be seen when in the document sheet stack within the apparatus 11. A suitable sensor SE-1 is arranged within the aperture 37 and is adapted to sense moving code markings on a code sheet placed in the apparatus 11, for a purpose to be described hereinafter.

As shown in FIGS. 1 and 2, sorting apparatus 12 comprises a base frame which supports upper and lower sorting assemblies or modules 40, 41 respectively. The lower sorting assembly 41 includes a unitary framework supporting a series of bins or trays 42 which receive copy sheets in a downward direction. Similarly, the upper sorting assembly 40 has a unitary framework which supports a series of trays or bins 43 for receiving copy sheets.

Sheets are transported from the processor 10 to the sorting apparatus by way of a belt transport 44 extending across the full width of a sheet inserter module 45 arranged between the output transport 31 for the processor 10 and an input opening 46 formed in the frame of the sorter apparatus 12. When the inserter module 45 is not in use and the system is in the copying/collating mode, the transport 44 serves as part of the paper path for copy sheets from the processor 10 to the sorter apparatus 11. The sheets pass through the opening 46 in the apparatus 12 to a pair of pinch rolls 47 which direct their travel to either of the modules 40, 41, depending upon whether one of the modules contains previously sorted sheets. If directed to the lower module 41, copy sheets are transported to a horizontal transport 48 made up of a plurality of horizontal driven belts and free wheeling rollers positioned below the sheet path. The sheets traveling on the horizontal belts are deflected downward into an appropriate tray 42 by gates 49 actuated into the sheet path by suitable solenoids, one for each tray, which are sequentially energized by the logic circuitry in the programmer P.

The upper sorting assembly 40 includes a transport made up of horizontal belts 50 which move above the sheet path and free wheeling rollers positioned below the sheet path. Suitable gates 51 serve to deflect the copy sheets into the bins or trays when actuated by the control logic in the programmer P. In structure and in operation, the upper and lower sorting assemblies 40, 41 and attendant transports are identical.

To transport the copy sheets into the upper sorting assembly, there is provided a vertical transport made up of vertical belts 52 which move against rollers 53. The vertical transport receives the sheets when a solenoid actuated sheet deflector 54 is positioned so as to direct the sheet upwardly in accordance with the referred to control logic. Further details of sorting apparatus 12 is not necessary to understand and appreciate the present invention. The sorting apparatus is fully disclosed in U.S. Pat. Nos. 3,709,492 and 3,870,295, which are incorporated herein by reference.

The inserting apparatus 45 is supported entirely above the transport 44 by any suitable means between the processor 10 and the sorting apparatus 12. As shown in FIG. 2, the apparatus 45 includes a supply tray 60 which is adapted to support a goodly number of sheets 62 which may be insertion sheets or stacks of sheets to be collated, for rather long reproduction jobs. Preferably, such a quantity should extend to 1000 sheets or sheet items. In the copying/inserting/sorting mode of operation as will be presently described, copy sheets to be interleafed with insert material, etc. are produced in the processor or copier 10.

Figure 3:
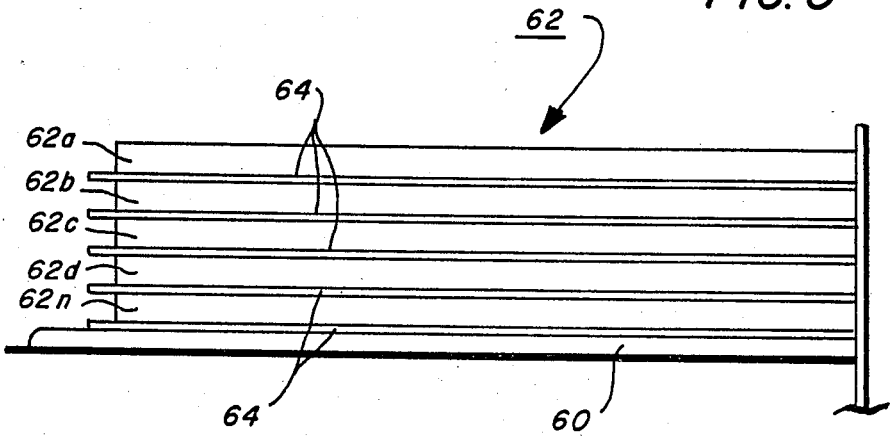
FIG. 3 is an enlarged, fragmentary view of the inserter feed tray showing a plurality of groups of different insert sheets.

As shown in FIG. 3, the sheets 62 are divided into groups of insertable items by one or more dividers 64 which, as will be described below, are also sheet items bearing coded areas to be sensed and utilized for control purposes.

The inserter sheets 62 may comprise any desirable sheet-like material which are to be inserted into or applied to copy sets being compiled in the sorter trays 42, 43 during a reproduction job. These sheet materials may be copy set covers, separators for chapterizing sections of each copy set, photos, sheets of various colors, weights or sizes, sheets with file tabs, etc. Any desired number of dividers 64 may be utilized to provide an equal number of groupings of sheets 62*a*, 62*b*, 62*c*, 62*d*, . . . 6*n* to be inserted into copy sets as long as the total number of sheets do not exceed the capacity of the tray 60. The operator is not required to count the number of insert sheets in each group but only to be assured that there are more sheets than the number of copy sets to be produced.

The insertion feed tray 60 is associated with a belt-type top sheet feeder 65 which, upon a signal from the control logic for the apparatus 45, is adapted to separate each sheet material 62 and divider sheets 64 from the stack of sheets in the tray and to convey the separated material to a horizontal plate guide means 66. The sheet material is then further transported by a driven roll pair 67, to a deflector gate 68 which deflects the sheet downwardly into a curved plate guide means 69. Further transporting of the sheets through the guide means 69 is provided by driven roll pairs 70 to place the sheet material onto the transport 44 to be conveyed to the sorting apparatus 12 and eventual insertion into copy sets being collated therein.

The deflector gate 68 is normally in the position shown in full lines in FIG. 2 during sorting of copy sheets and inserting of sheet material 62 during a reproduction job. After an insertion stack 62*a*, 62*b*, 62*c*, 62*d* or . . . 62*n* has been utilized for insertion and its need has terminated, all remaining sheet material in that stack will continue to be fed off the tray 60 and into an overflow tray 72. Termination of the need for the sheet material from a particular stack, say for example, stack 62*a*, will cause a control signal from the machine logic, produced by the programming of a desired number of copy sets and the arrival at that count, to rotate the gate 68 to the dotted position shown in FIG. 2. Upon this occurrence, the excess sheet material in the stack 62*a* being fed off the tray 60 by the feeder 65, will be deflected by the gate 68 into an upwardly projecting guide device 74 to be transported thereby and eventually deposited in the tray 72.

Depositing of the excess sheet material from the individual stacks 62*a*, 62*b*, 62*c*, 62*d*, . . . 62*n* as groups into the overflow tray 72 results in these groups being in the same order from the order used when placed in the insertion tray 60, and face down. In the event the operator wishes to repeat the reproduction job, or to complete the original job which demands more copy sets than the capacity of the sorting apparatus, and must be accomplished in multiple steps, the operator need only to remove the sheet material in the tray 72 in an undisturbing manner, invert the same, and return the material to the tray 60 for further machine operation.

To complete the structure of the operating devices for the insertion apparatus 45, a motor M-1 for driving the feeder 65 and the sheet transporting devices 67, 70, etc., is provided. An elevator motor M-2 is suitably connected to the tray 60 to elevate the same as sheet material is fed off the top of the stack 62. A suitable stack height sensor (not shown) may be applied to the tray supporting structure for controlling energization of the motor M-2. Positioning of the gate 68 to either of its two operating positions may be effected by a solenoid SOL-1 suitably connected to the machine logic for operating control thereof.

For insertion control purposes, the document sensor SE-1 cooperates with an insertion material sensor SE-2 positioned adjacent the sheet feeder 65, and arranged for sensing code indications on the divider material 64. As shown in FIGS. 7 and 8, these sensors are electrically connected to a control console C for the inserting apparatus 45, which interfaces with the programmer P for the processor 10. The control arrangement is adapted to permit the apparatus 45 to integrate on-line with the production of copy sheets by the processor 10 in conjunction with the use of the automatic document handling apparatus 11 and the sorting apparatus 12 in the copier/inserter/sorter mode.

In the other mode of operation, the inserter/collator mode, control arrangement provided in the console C is adapted to permit the use of the inserting apparatus 45 as an off-line or stand-along device; that is, the console C is arranged to permit only the combined use of the insertion apparatus 45 with the sorting apparatus 12, and in various manners. An example of off-line use is when only a sorting function is desired for sheet material previously produced off-line from other reproduction copiers, or comprise original documents, inserts, etc., or mixes thereof. Still another example of off-line use involves the intervention of the operator at asynchronous events, such as when manual insertion is added to the sorting job when only selected ones of the sorting bins 42, 43 are to receive selected inserts. When used in the on-line copying/inserting/sorting mode, the system 10, 11, 12, 45 is under control of the console C with the interface action with the programmer P. When used in an off-line mode, the console C is utilized solely for programming and control.

In operation, as depicted in the flow diagrams of FIG. 4*a*, 4*b*, 4*c*, when inserting is to be programmed for an on-line mode of operation, the programmer associated with the operator control console C works in conjunction with the programmer P which is manipulated by inputting the number of copy sets to be produced. Code sheets are interspersed with the document sheets placed in the document handling apparatus 11, each code sheet being so positioned in the set of document sheets as indicative of where insert sheet material is to be correspondingly positioned in the collated copy sets in the apparatus 12. Code sheets are also placed in the insertion tray 60 between stacks of different sheet material or groups which are to be inserted in the copy sets as they are being produced.

Three types of code sheets are envisioned in the present invention: (1) an "End of Insert" sheet to be used in the tray 60 to determine the end of each group of insert material when multiple groups of insert material are stacked on one another, and thereby to give control back to the hose processor 10, 11 and its associated programmer P; (2) an "Insert Code" sheet placed within the document sheets in the document apparatus 11, which instructs the inserting apparatus 45 to begin an insert process; and (3) an "Auxiliary Tray Select" sheet placed with the document sheets which when sensed will cause the processor to use the auxiliary 23 for only the next document sheet in the apparatus 11. This latter code sheet may be used in conjunction with the supply 23 for covers, etc.

Upon commencing the printing operation, for the automatic mode, such as by activating the "Print" button in the programmer P console, each document sheet is brought upon the platen 14 and exposed a predetermined number of times, depending upon the built-in software of the programmer. Since the illustrated host processor 10 and document apparatus 11 is the commercial duplicator of the Xerox model 9200 ®, twenty-five exposures of each document sheet will occur before this document sheet is removed from the platen and the succeeding sheet placed thereon, and so on. Some duplicator models, such as the Xerox duplicator 9500 ® may include a sorter arrangement having two sorter modules each having twelve bins. The software for this model would produce twelve exposures of each document sheet when placed on the exposure platen. In the system illustrated in FIG. 1, each of the sorting modules 40, 41, includes twenty-five bins so that the copy sheets produced by the twenty-five consecutive exposures of each document sheet will be sorted one to each bin, utilizing an entire module. Assuming more than twenty-five copy sets have been programmed, one of the sorting modules 40 or 41 is utilized to receive the first twenty-five completed copy sets, and automatically, as disclosed in the foregoing cited U.S. Pat. Nos. 3,709,492 and 3,870,295, the other empty sorting module is brought into service to receive the next twenty-five completed copy sets, and so on.

During the first cycling of the stack of document sheets in the apparatus, the first code sheet in the stack will eventually be exposed through the opening 37 to be sensed by the sensor SE-1. Upon this occurrence, the processor 10 suspends further document handling and copying by way of inserter control console C, except to finish copying and to effect sorting of the last document sheet which was multi-exposed just prior to the sensing of the first code sheet. Control is then transferred to the logic circuit in the console C in the inserter apparatus 45 which energizes the motor M-1 to cause activation of the feeder 65. This, in turn, effects seriatim feeding of the insert sheet material 62*a*, which are transported into the trays 43 of the sorter module 40, one sheet for each bin.

The logic for the apparatus 45 receives the data of the preselected quantity of copy sets to be produced from the programmer P for the processor 10. The flow diagrams of FIG. 4*a*, 4*b*, 4*c*, depicts operational control for on-line copy sheet production and inserting of insert sheets from the inserter apparatus 45. For the illustrated system and the foregoing description thereof, if less than twenty-five copy sets are programmed, the inserter 45 will provide insert sheets equal in number to the programmed number of copy sets and the top sorter module 40 will receive these sheets, one bin at a time until the programmed number has been reached. When this occurs, the deflector gate 68 will be pivoted to its dotted-line operating position so that the remaining insert sheets 62*a* which continue to be fed, are directed into the overflow tray 72. After the last insert sheet is separated from the insert stack 62*a* and is being transported to the tray 72, the first coded sheet 64 is exposed and sensed by the sensor SE-2. As shown in the diagrams of FIG. 4*a*, 4*b*, 4*c*, the logic in the apparatus instructs the feeder 65 to feed this coded sheet to the tray 68, to terminate its operation, and to return control of the reproduction back to the programmer P for the processor 10.

The production job automatically resumes, and the next document sheet in the appartus 11 is fed to the platen 14 for exposure a number of times equal to the number of copy sets programmed to be produced. It was assumed previously that this number was less than twenty-five. Copy sheet production and sorting continues until the next code sheet in the apparatus 11 is sensed by the sensor SE-1 whereupon, as before, further copying ceases and control is again transferred to the inserter apparatus for activating the feeder 65 for the second group of inserter sheets 62*b*, and so on until the programmed number of copy sets have been produced and the requisite insert sheets from all of the groups have been properly applied.

If the desired number of copy sets to be produced is over twenty-five but not over fifty, the above operation and sequencing occurs for each of the sorter modules 40, 41. The module 40 is utilized first for the first cycling of document sheets and will receive the first twenty-five completed copy sets with inserts, whereupon the second module 41 becomes activated to receive the second grouping of twenty-five or less copy sets with inserts from a second cycling of the document sheets.

In the inserter/collator mode of operation, or off-line, the processor 10 and document apparatus 11 are not utilized. The operator loads the inserter tray 60 with previously prepared or copied groups of sheet material 62*a*, 62*b*, 62*c*, 62*d*, . . . 62*n* which are to be collated into sets along with the desired code sheets 64 for terminating the transporting of the copied material from each respective into the collated sets. The control console C for the apparatus 45 is provided with a keyboard K to permit programming of a desired number of sets to be collated from the different groups. The coded sheets 64 serve to control the removal of the remaining insert sheets from each group of sheets prior to being sensed by the sensor SE-2 as was the procedure for the copying/inserting/sorting mode, described in the foregoing paragraphs. FIGS. 5*a*, 5*b*, depict the control operation of the inserter/collator while used in the automatic feed mode, as described above. The inserter/collator may also be used in the manual mode which is operator selective from the console C. As shown in FIG. 2, the console includes a mode selection arrangement of a switch 101 for manual mode use and a switch 102 for automatic mode of use. The diagram of FIG. 6 illustrates the control functioning for both manual and automatic operation of the inserter/collator.

The block diagrams in FIGS. 7 and 8 illustrate the circuit systems for implementing the on-line arrangement of FIGS. 4*a*, 4*b*, 4*c* and the off-line arrangement of FIGS. 5*a*, 5*b*, respectively.

In the copying/inserting/sorting mode of operation, the logic system for the system comprising the components 10, 11, 12, and 45 are devised so that throughput is maintained at a maximum. To this end, timing of the deactuation of document apparatus 11, when a coded sheet is sensed, is such that as the last copy sheet for the copying of the last document sheet, before the coded sheet was sensed has been placed on the transport 44, insert sheets from the tray 62 are conveyed immediately behind the last copy sheet so that no machine pitch or copy cycle is lost during the inserting process. In like manner, when the last insert sheet is fed to the transport 44, and while excess insert sheets in the affected group are carried to the excess tray 72, the document apparatus 11 would have already been actuated and copy sheets would have been produced and moving to the transport 44 to follow closely behind the last insert sheet thereon. Therefore, in the return to copying sequence, there is no loss of machine pitch or cycle.

While the invention has been described to the structure disclosed, it is not confined to the details set forth, but is intended to cover such modifications or changes as may come within the scope of the following claims.

We claim:

1. A sheet inserter apparatus for use with a sorting apparatus adapted to collate sheets into sets having a plurality of sheet receiving bins and means for transporting sheets seriatim to the receiving bins and to direct sheets in succession therein during collation thereof, and a copier having means for presetting the number of copy sets to be reproduced, comprising, a sheet feed mechanism having a support tray upon which a stack of insert sheets is placed, the stack being devised of groups of like insert sheets each group being separated by a code sheet, and a sheet feed means adjacent the stack being adapted to feed sheets from the stack upon actuation thereof, a sheet collecting tray arranged for collecting some of the sheets from said support tray, a deflector gate arranged in the path of movement of the insert sheets being fed from the support tray and having one operative position wherein the sheets being fed are directed to the transport means for the sorting apparatus and another operative position wherein sheets are directed to said collecting tray, means for actuating said gate to at least one of its operative positions in response to a control signal, and means for producing said control signal in response to the number of copy sets pre-set in the copier.

* * * * *